US005924696A

United States Patent [19]

Frazier

[11] Patent Number: 5,924,696

[45] Date of Patent: Jul. 20, 1999

[54] FRANGIBLE PRESSURE SEAL

[76] Inventor: Lynn Frazier, 210 N.W. 122nd, Oklahoma City, Okla. 73114

[21] Appl. No.: 08/794,685

[22] Filed: Feb. 3, 1997

[51] Int. Cl.[6] ..... E21B 33/10

[52] U.S. Cl. ..... 277/336; 138/90; 166/188; 166/318

[58] Field of Search ..... 138/89.91, 90; 277/336, 626, 627, 917, 943; 166/133, 188, 317, 318

[56] References Cited

U.S. PATENT DOCUMENTS

| | | | |
|---|---|---|---|
| 244,042 | 7/1881 | Farrar | 166/317 |
| 3,015,469 | 1/1962 | Falk | 138/89 X |
| 4,218,299 | 8/1980 | Lindell et al. | 204/435 |
| 4,510,994 | 4/1985 | Pringle | 166/156 |
| 4,541,484 | 9/1985 | Salerni et al. | 166/317 X |
| 4,553,559 | 11/1985 | Short, III | 277/637 X |
| 4,605,074 | 8/1986 | Barfield | 166/317 X |
| 4,739,799 | 4/1988 | Carney et al. | 138/89 |
| 4,813,481 | 3/1989 | Sproul et al. | 166/317 X |
| 4,969,524 | 11/1990 | Whiteley | 166/317 X |
| 5,012,867 | 5/1991 | Kilgore | 166/188 |
| 5,511,617 | 4/1996 | Snider et al. | 166/291 |

FOREIGN PATENT DOCUMENTS

| | | | |
|---|---|---|---|
| 1423293 | 2/1976 | United Kingdom | 166/318 |

OTHER PUBLICATIONS

Sketches labeled 1 and 2—believed to be known in public use or on sale at least one year before Feb. 3, 1997.

*Primary Examiner*—Lynne A. Reichard
*Assistant Examiner*—Greg Binda
*Attorney, Agent, or Firm*—McAfee & Taft

[57] ABSTRACT

A frangible sealing disk for use downhole in combination with packer components. The sealing disk is a molded ceramic disk having a circular seating face and extending centrally through a dome-shaped seal. The seal is preferred for use in combination with a packer assembly for pressure sealing the borehole, either up hole or down, so that the seal may be broken away easily when it is desired to remove or reset the packer assembly.

11 Claims, 2 Drawing Sheets

FRANGIBLE PRESSURE SEAL

BACKGROUND OF THE INVENTION

1. Field of the Invention

The invention relates generally to pressure seals for use in oil well drilling strings and, more particularly, but not by way of limitation, it relates to an improved frangible sealing disk that may be used with packers, bridge plugs or the like as a break-away seal.

2. Description of the Prior Art

The prior art includes numerous types of sealing disks, both permanent and actuable, that may be used in conjunction with drill strings and related elements but such prior types of seals have not been of frangible construction but of permanent, hard materials that necessitated their physical removal from the drill string to release pressure flow. Nor has the prior type had a radial curvature to hold against pressure. This style also relieves problematic debris from falling into the wellbore.

SUMMARY OF THE INVENTION

The present invention relates to improvements in construction of drill or tubing string seals as used with packers, bridge plugs and the like, such improvement comprising constructing the seal of selected ceramics, a frangible material, in a precise arcuate shape offering maximum pressure resistance. Ideally, the frangible seal is a molded, arcuate configuration formed from a ceramic material obtained from the Coors Ceramic Company, which is employed in combination with an elastomer packing O-ring to isolate pressure either above or below a designated point in a tubing or drill string. When it is desired to remove the seal from the pipe string, it is only necessary to lower a breaking implement down the bore to strike the sealing disk and shatter it into pieces whereupon it will fall away down the bore of the pipe string leaving the bore open and communicating throughout.

Therefore, it is an object of the present invention to provide a borehole seal that is readily removable by breakage carried out by wielding a breaking implement within the borehole.

It is also an object of the present invention to form a seal out of frangible ceramic material that can be readily broken away to release the seal.

It is yet further an object of the invention to provide a ceramic seal in the form of an arcuate disk formed to present maximum strength to forces normal to tangential.

Finally, it is an object of the present invention to provide an arcuate ceramic seal member for use in combination with a sealing O-ring to provide pressure isolation adjacent a bridge plug, packer or similar pressure isolation component.

Other objects and advantages of the invention will be evident from the following detailed description when read in conjunction with the accompanying drawings that illustrate the invention.

BRIEF DESCRIPTION OF THE DRAWINGS

FIG. 6 is an elevation of a frangible seal as utilized with a bridge plug shown in elevation with one side shown in cutaway section.

DETAILED DESCRIPTION OF THE INVENTION

Figure 1:
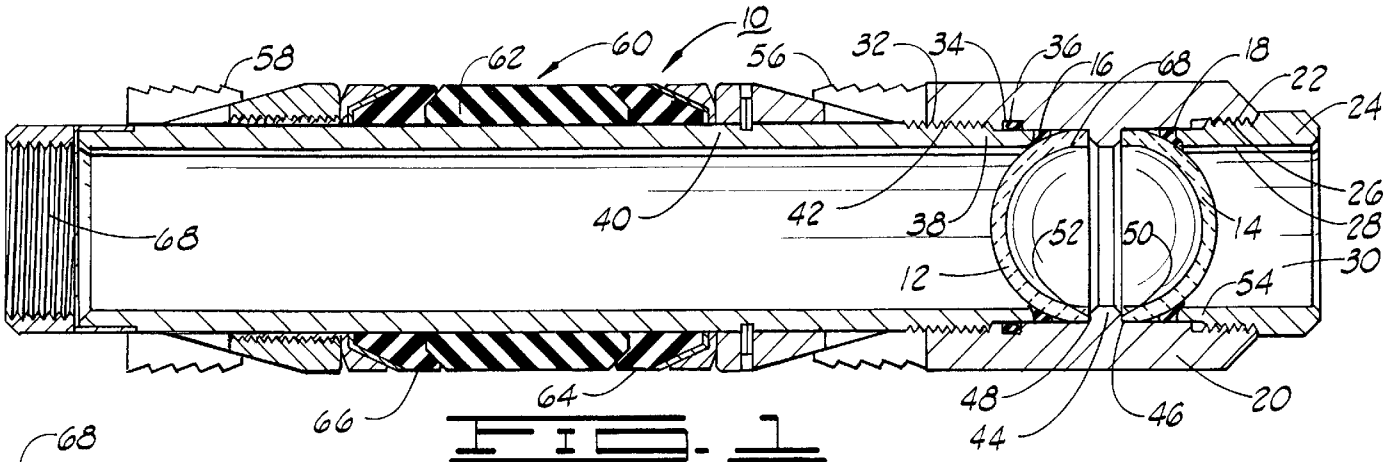
FIG. 1 is a sectional view in elevation of a two way seal assembly in combination with a packer assembly.

FIG. 1 illustrates a pair of frangible disks 12 and 14 used in combination with a frac plug 10 to provide isolation against both uphole and downhole pressure. Each of the frangible disks 12 and 14 is employed in association with a respective elastomer sealing O-ring 16 and 18 disposed around respective curved, sloping portions of convex surfaces of disks 12 and 14 as shown in FIG. 1. A cylindrical plug body 20 of selected diameter defines a central bore with threads 22 for receiving a pipe or tubing stub 24 threadedly gripped by means of threads 26 to define the inner wall 28 and central bore 30. The opposite end of plug body 20 includes threads 32 and groove 34 with O-ring 36 for receiving one end 38 of cylinder 40 therein as secured by means of threads 42.

The plug body 20 is formed with an annular formation 44 at about the middle interior which includes annular shoulder surfaces 46 and 48 that function to support the lower faces 50 and 52, respectively, of frangible disk members 14 and 12. The lower frangible disk 14 is positioned and an O-ring 18 assumes a crushed seal attitude with insertion of comb 54 of end plug 24 thereby to maintain frangible disk 14 in tight seal. The opposite or upward facing frangible disk 12 is maintained in sealed seating by means of the crushed O-ring 16 as maintained seated by threaded insertion of cylindrical body 40 within threads 32 of plug body 20. Thus, in this case, ceramic disks 12 and 14 are utilized in a back-to-back relationship in what is termed a ceramic dome configuration.

The frac plug cylinder body 40 includes a selected type of lower slips 56 and upper slips 58 disposed therealong in circumfery, depending upon the type of slip formation. A combination packing element 60 is utilized with an 80 durometer packing sleeve 62 buttressed by respective lower and upper 90 durometer packing elements 64 and 66 positioned on each side. Finally, internal threads 68 within the plug body cylinder 40 provide connection to whatever the supporting assembly or string.

Figure 3:
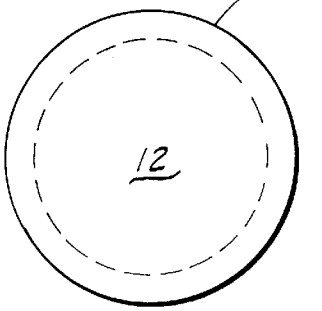
FIG. 3 is a top plan view of the frangible seal of FIG. 2.
Figure 2:
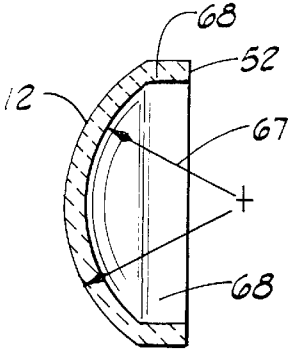
FIG. 2 is a cross-sectional view of a first form of frangible seal.
Figure 5:
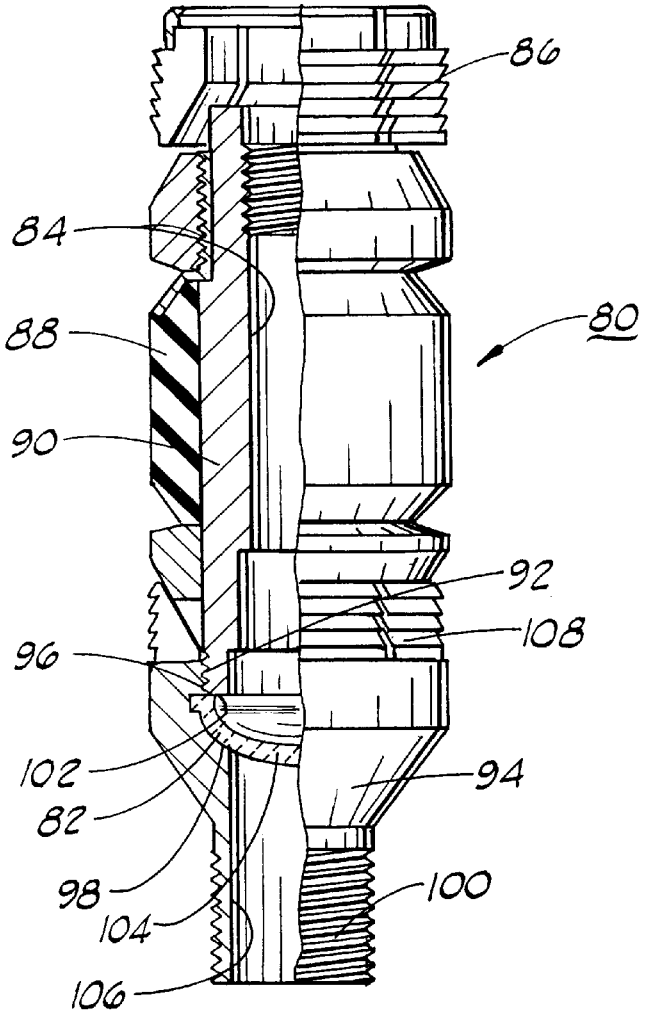

FIGS. 2 and 3 show a first form of frangible ceramic disk 12 such as that utilized in the dome combination of FIG. 1. The disk 12 is formed with a dome of predetermined radius of curvature 67 that provides maximum strength to forces normal to tangential, and terminates in a lower circumferential comb 68 having circular seating face 52 with all corners finished sharp, i.e., without chamfer. A ceramic disk of this configuration would be suitable for sealing of a 4.5 inch outside diameter frac plug rated at 6,000 psi and 200° F.

Figure 4:
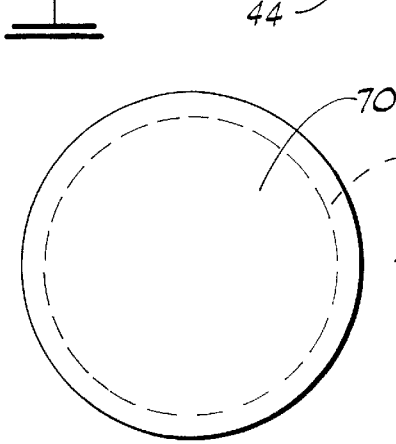
FIG. 4 is a top plan view of an alternative form of frangible seal.
Figure 5:
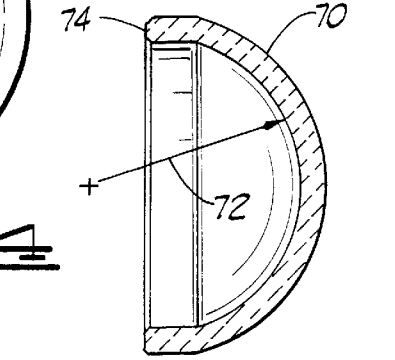
FIG. 5 is a cross-sectional view of the frangible seal of FIG. 4.

FIGS. 4 and 5 show an alternative formation of ceramic disk 70 having similar properties and a curvature radius 72 of 1.321R±0.032 inches, but having a 45° chamfer around the circular seating face 74. The ceramic disks are made by Coors Ceramic Company using Coors technical specification No. 800-900-001 which designates the guidelines for dimensional tolerancing and visual criteria.

Referring to FIG. 6, the packer assembly 80 incorporates a ceramic disk pressure seal 82 in a different manner. The packer 80 includes a bore 84, upper slips 86 and an array of packing elements 88 as supported on a cylindrical body 90. The cylinder body 90 includes bottom threads 92 for receiving a threaded capture sub 94 thereon. The capture sub 94 consists of an upper enlarged portion having threads 96 for secure engagement on cylinder threads 92 while defining a cupped seating space 98 wherein the ceramic disk 82 is received for operative positioning. The capture sub 94 then extends on downward to expose external threads 100 albeit such threading is not necessary in certain applications. The ceramic disk 82 is positioned with the bottom edge surface held against a lower rim 102 of cylinder body 90 by means of the cup space 98 of the capture sub 94, and the central portion, i.e., the domed portion 104 of ceramic disk 82 is maintained centered over the central bore 106 defined by capture sub 94. The lower slips 108 of packer 80 are disposed immediately above the capture sub 94 and function in well-known manner.

Figure 7:
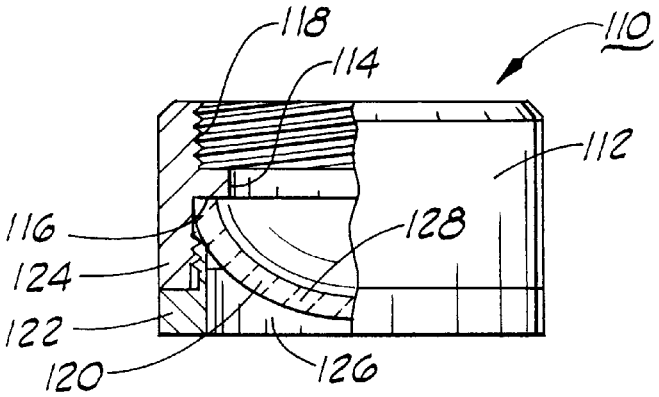
FIG. 7 is a screw-on plug body shown in elevation with one side in cutaway section.

FIG. 7 illustrates a screw-on plug 110 that may be used to provide the same function as capture sub 94. The bottom plug 112 defines a central bore 114 which is actually an annular shoulder having threads 118 formed thereabove and defining an annular shoulder 116 facing downward. The plug body 112 includes internal threads 118 which may be secured on threads 92 of the cylinder body 90 (see FIG. 6) to secure the lower region of the packer 80. A selected ceramic disk 120 may then be secured beneath annular surface 116 by means of a securing ring 122 which extends a securing ring upward for threaded engagement within the lower rim 124 of plug 112. Here again, the ring 122 defines a central bore 126 which exposes a large part of the dome surface 128 of ceramic disk 120. Such a plug 110 may be used for securing a downwardly directed ceramic disk 128 to withstand downhole pressures.

The bottom plug 112 may also be constructed to seat a ceramic dome type of seal. That is, a double up and down seal as illustrated in the FIG. 1 embodiment. The necessary dome seating structure could readily be molded into the seal seating arrangements or plugs accommodating such ceramic dome seals.

In operation, any of the ceramic disks, whether directed downhole or uphole to withstand incident pressures, is frangible to simply allow a striking implement lowered in the bore to break the ceramic disk centrally such that the constituent parts fall away down the string bore. Thus, there is no necessitation for special implements, withdrawal of the assembly, or in any way working of the drill string to relieve the pressure block by removing the seal.

The foregoing discloses a ceramic disk that is capable of withstanding elevated pressures and temperatures that may be encountered in downhole drilling situations. Further, use of the ceramic disk alleviates any problems inherent with subsequent releasing of the pressure block since it is only necessary to lower an instrument down the borehole and to break out the center of the ceramic disk while allowing the fragments to fall harmlessly down the borehole thus avoiding any accumulation of metal plates or other blockage implements at the site.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. An operative sealing combination comprising:

a downhole packer assembly having packing elements set to close off a borehole annulus;

a plug body secured below said packer assembly;

a dome shaped ceramic seal disposed dome-down in said plug body; a second dome shaped ceramic seal disposed dome-up above said dome-down dome shaped ceramic seal; and means secured in said plug body to retain said ceramic seals in blocking relationship to a central bore such that it is only necessary to break the ceramic seals to allow pressure relief.

2. The combination as set forth in claim 1 which further includes:

first and second elastomer O-rings seated around the convex sides of both the dome-up and dome-down ceramic seals with both ceramic seals being secured adjacent said plug body blocking said central bore.

3. An operative sealing combination comprising:

a downhole packer assembly having packing elements set to close off a borehole annulus;

a plug body secured below said packer assembly;

a dome shaped ceramic seal disposed dome-down in said plug body;

means secured in said plug body to retain said ceramic seal in blocking relationship to a central bore such that it is only necessary to break the ceramic seal to allow pressure relief; and an elastomer O-ring seated around the convex side of the dome and sealingly seated adjacent the plug body.

4. A drill or tubing string frangible pressure seal, comprising:

a ceramic member having a central formation with a convex outer surface to withstand a downhole pressure acting against the convex outer surface when the frangible pressure seal is in a drill or tubing string assembly in a well, the ceramic member further having a peripheral formation adjoining the central formation and including a seating face to abut a support surface of the drill or tubing string assembly; and a sealing member disposed around a portion of the convex outer surface to create a seal between the convex outer surface of the ceramic member and the drill or tubing string assembly.

5. A drill or tubing string frangible pressure seal, comprising:

a ceramic member having a central formation with a convex outer surface, the ceramic member further having a peripheral formation adjoining the central formation and including a seating face to abut a support surface of a drill or tubing string assembly; and a sealing member disposed around a portion of the convex outer surface to create a seal between the ceramic member and the drill or tubing string assembly;

wherein the portion of the convex outer surface on which the sealing member is disposed is spaced from the peripheral formation and the seating face thereof.

6. A drill or tubing string frangible pressure seal, comprising:

a ceramic member having a central formation with a convex outer surface, the ceramic member further having a peripheral formation adjoining the central formation and including a seating face to abut a support surface of a drill or tubing string assembly; and a sealing member disposed around a portion of the convex outer surface to create a seal between the ceramic member and the drill or tubing string assembly;

wherein the peripheral formation includes a cylindrical wall extending from an end of the central formation and the convex surface thereof and terminating in a circular surface defining the seating face.

7. A drill or tubing string frangible pressure seal as defined in claim 6, wherein the convex surface has a predetermined radius of curvature.

8. A drill or tubing string sealing disk, comprising:

a ceramic dome having a strength to withstand downhole pressures and temperatures in a well but frangible by impact at the ceramic dome; and a cylindrical ceramic formation extending from the dome to provide a seating face;

wherein the ceramic dome is adapted to receive an O-ring around a curved and sloping portion thereof, and the seating face of the cylindrical ceramic formation is adapted to engage a support surface of a drill or tubing string.

9. A packer assembly for a drill or tubing string, comprising:

a support to connect to a drill or tubing string, the support having a bore defined therethrough;

a packer connected to the support;

a frangible dome shaped ceramic seal spaced from the packer and connected to the support such that a convex side of the dome shaped ceramic seal is disposed to face towards a downhole pressure to be resisted by the ceramic seal and the ceramic seal blocks the bore through the support until the ceramic seal is broken; and a sealing ring seated around a portion of the convex side of the dome shaped ceramic seal and sealingly seated adjacent the support such that a seal is formed between the portion of the convex side and the support.

10. A packer assembly for a drill or tubing string, comprising:

a support to connect to a drill or tubing string, the support having a bore defined therethrough;

a packer connected to the support;

a frangible dome shaped ceramic seal spaced from the packer and connected to the support such that the ceramic seal blocks the bore through the support until the ceramic seal is broken; and a second dome shaped ceramic seal connected to the support such that the dome of the second dome shaped ceramic seal is oriented opposite to the dome of the first-mentioned dome shaped ceramic seal but also such that the dome of the second dome shaped ceramic seal blocks the bore through the support until the second dome shaped ceramic seal is broken.

11. A packer assembly as defined in claim 10, further comprising first and second sealing rings seated around the convex sides of the domes of both of the ceramic seals and sealingly seated adjacent the support.

* * * * *